United States Patent [19]

Äsbrink et al.

[11] Patent Number: 4,812,811

[45] Date of Patent: Mar. 14, 1989

[54] ALARM TAG

[75] Inventors: Leif Äsbrink, Vingäker; Ulf Graflind, Sollentuna, both of Sweden

[73] Assignee: Intermodulation and Safety System AB, Sweden

[21] Appl. No.: 104,869

[22] PCT Filed: Jan. 23, 1987

[86] PCT No.: PCT/SE87/00028

§ 371 Date: Sep. 25, 1987

§ 102(e) Date: Sep. 25, 1987

[87] PCT Pub. No.: WO87/05136

PCT Pub. Date: Aug. 27, 1987

[30] Foreign Application Priority Data

Feb. 13, 1986 [SE] Sweden ..... 8600647

[51] Int. Cl.[4] ..... G08B 13/14

[52] U.S. Cl. ..... 340/571; 340/568; 340/572

[58] Field of Search ..... 340/571, 572, 568

[56] References Cited

U.S. PATENT DOCUMENTS 4,380,097 4/1983 Keifer ..... 340/572

4,622,543 11/1986 Anderson, III et al. ..... 340/572

4,686,513 8/1987 Farrar et al. ..... 340/572

FOREIGN PATENT DOCUMENTS 1085704 10/1967 United Kingdom ..... 340/568

*Primary Examiner*—Charles A. Ruehl

*Assistant Examiner*—Anh H. Tran

*Attorney, Agent, or Firm*—Silverman, Cass, Singer & Winburn, Ltd.

[57] ABSTRACT

An alarm device, comprising a so-called alarm tag consisting of two parts arranged so as to be placeable each on one side of an article, for example an article of clothing, of fur or other article, where a needle is provided to extend from one part through the article to the second part, which alarm tag comprises devices for receiving a magnetic alternating field emitted to the alarm tag. According to the invention, the alarm tag (1) comprises devices (8,9,11,12) capable to emit an acoustic signal when the parts (2,3) of the alarm tag (1) move away from each other when the alarm tag (1) is put in a first, active, state and not to emit an acoustic signal when the parts (2,3) of the alarm tag (1) move away from each other when the alarm tag (1) is put in a second, inactive, state.

6 Claims, 2 Drawing Sheets

ALARM TAG

Figure 1:
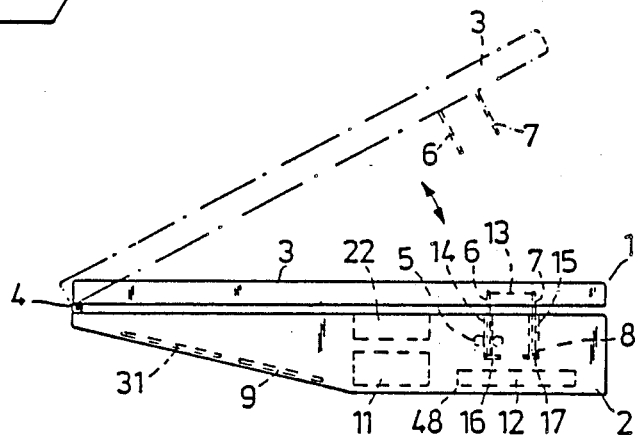

This invention relates to an alarm tag of the kind, which in shop trading, for example in department stores and the like, is attached to clothes and other articles and intended to trigger an alarm when a person with an article, to which the alarm tag is attached, passes through an investigation zone. Several different designs of such an alarm tag are known.

Such alarm tags normally are arranged so as to be actuated by a magnetic field emitted in an investigation zone and thereby to re-emit a magnetic field with a characteristic, which triggers an alarm when the re-emitted magnetic field is received and detected.

As regards clothes and other textiles, such as fur goods and like articles, several known alarm tags are designed so as to be divisible into two pieces and comprise a needle intended to join the two pieces together. Prior to their joining together, the pieces are placed each on one side of a part of an article of clothing or corrsponding article, whereafter the needle is threaded through the article to join together the two pieces of the alarm tag.

Alarm tags of known type are also provided with a locking device, in order to prevent unauthorized dismantling of the alarm tag. According to one embodiment, the needle constitutes a part of the locking device.

The locking devices generally are of good workmanship, in the sense that a person not knowing the structural design of the alarm tag and not having access to a special means for dismantling the tag must apply considerable force to the tag for dismantling the same.

Known systems are based on the principle that it must be very difficult to dismantle the tag and remove it from the article of clothing or corresponding article without destroying the article.

At a cashier's desk shop employees remove the alarm tag with said special means in connection with the payment of the article.

It was found, however, that articles provided with alarm tags are stolen to an ever increasing degree. This is largely due to the fact, that persons to a greater extent than previously have the knowledge of how to dismantle a certain alarm tag and also have the equipment therefor. The person in question, thus, after having taken the article from its place, removes the alarm tag and leaves the shop through the investigation zone without taking along the alarm tag. Thereby no alarm is sounded.

The present invention provides an alarm tag, which is a very effective protection against theft, even when it is opened unpermittedly.

The present invention is based on the principle, that the alarm tag can be dismantled or divided, but when this takes place alarm is triggered, provided that the alarm tag is not de-activated. The alarm tag, further, triggers an alarm when it is present in an investigation zone of the aforesaid kind.

The present invention, thus, relates to an alarm device comprising a so-called alarm tag, which consists of two parts arranged so as to be placeable each on one side of an article, for example an article of clothing, of fur or another article, where a needle is provided to extend from one part through the article to the second part, which alarm tag comprises means for receiving a magnetic alternating field emitted to the alarm tag, and is characterized in that the alarm tag comprises means capable to emit an acoustic signal when the parts of the alarm tag move away from each other, when the alarm tag is in a first, active, state, and not to emit an acoustic signal when the parts of the alarm tag move away from each other, when the alarm tag is in a second, inactive, state.

Figure 2:
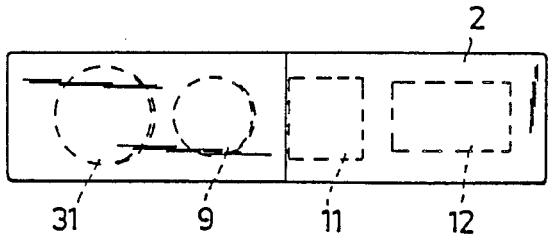
Figure 3:
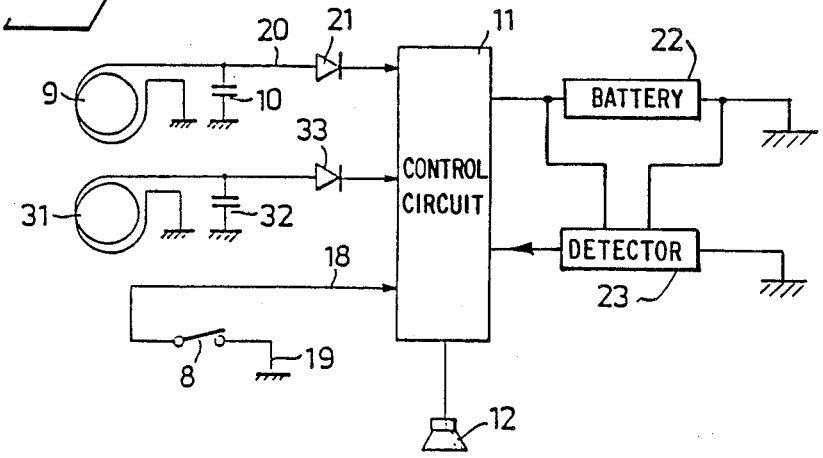
Figure 4:
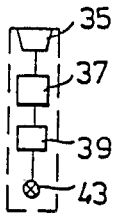
Figure 5:
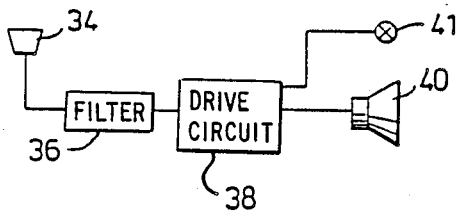
Figure 6:
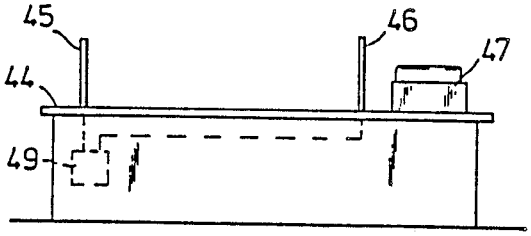
Figure 7:
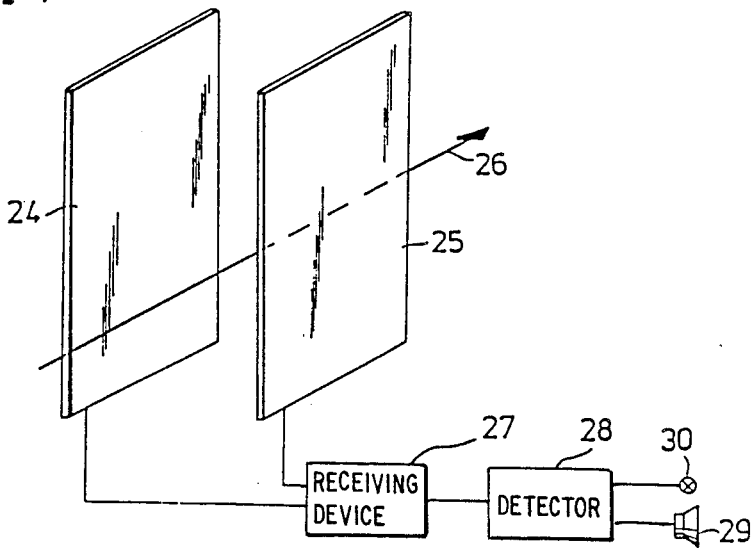

The invention is described in greater detail below, with reference to embodiments of the invention shown in the accompanying drawings, in which FIG. 1 shows schematically an alarm tag according to the invention seen from the side, FIG. 2 schematically shows the alarm tag seen from below, FIG. 3 shows a schematic block diagram of the electronics of the alarm tag, FIG. 4 shows a receiving alarm device, FIG. 5 shows a type of receiving alarm device other than that shown in FIG. 4, FIG. 6 shows schematically a cashier's desk provided with a deactivation zone, FIG. 7 shows schematically an indication zone of known kind.

In FIG. 1 an alarm tag 1 of the kind here concerned is shown schematically. The alarm tag consists of two parts 2,3, which are arranged so as to be placeable each on one side of an article, for example an article of clothing, of fur or another article. The parts 2,3 are joined together, for example, by a hinge 4 or other link and can be locked one to the other by one or several needles 6,7 co-operating with a known locking device of the kind used at present at alarm tags of known kind, for example a plurality of steel balls or steel lugs acting against the needles. The locking device has the object to prevent the parts of the alarm tag from being moved away from each other without applying a special tool, which usually comprises magnets actuating the steel balls or other parts of the locking device 5.

In FIG. 1 fully drawn lines indicate the two parts co-operating with each other, i.e. when the alarm tag is in its closed state. Dash-dotted lines indicate the parts 2,3 moved away from each other, i.e. when the alarm tag is in its open state. The alarm tag 1 comprises at least one needle 6,7 intended in locked position of the alarm tag to extend from the upper part 3 through an article to the lower part 2. The alarm tag, thus, cannot be removed from the article when it is in its closed position, without destroying the article. The alarm tag, further, comprises means for receiving a magnetic alternating field emitted to the alarm tag.

According to the invention, the alarm tag comprises means to emit an acoustic signal when the alarm tag is being opened and put in a first, active, state. The said means also are arranged so as not to emit any acoustic signal when the alarm tag is being opened and put in a second, inactive, state.

The said means comprises a switch with the general designation 8 in FIGS. 1 and 3, a coil 9, a detector circuit 10, a control circuit 11 and a loudspeaker 12. In FIGS. 1 and 2 the details 8–12 are shown located in the alarm tag in different places. In FIG. 3 the details are shown in the form of a block diagram of the electronic parts of the alarm tag.

The switch 8 is capable to open a circuit when the parts 2,3 of the alarm tag 1 move away from each other, i.e. are opened. According to a preferred embodiment, the switch comprises one or several needles 6,7, which in closed position of the alarm tag are arranged to form a closed circuit between the parts 2,3 when the circuit is opened when the needle or needles are moved away from one, or, where appropriate, the other part 2,3 of the alarm tag 1. At the embodiment shown in FIG. 1 the two needles 6,7 are attached in the upper part 3 and joined together in the upper part 3 by an electric conductor 13. The needles 6,7 extend downwards into holes 14,15 in the lower part 2, when the tag is being closed. At the bottom of each hole 14,15 in the lower part 2 a contact sheet 16,17 is located, which contact sheets are connected via electric conductors 18,19 to the control circuit 11. Said locking device 5 is located in connection to one of said holes.

When the alarm tag is opened, thus, the contact between the contact sheets 16,17 is broken, whereby the circuit is opened. The control circuit 11 hereby is capable to emit a signal to the loudspeaker 12, in the case that the alarm tag is put in its said active state.

The alarm tag normally is in its active state. The said means for putting the alarm tag in its second, inactive, state comprise a receiving circuit with said coil 9 and a first detector circuit 10. Said first detector circuit 10 can consist of a capacitor, in order together with the coil to form an LC-circuit, which is tuned to a magnetic alternating field of a first predetermined frequency F1.

When an alternating field of the first frequency F1 is received, the detector circuit emits a signal to the control circuit 11 via the conductor 20, after a possible rectification with a diode 21. The control circuit 11 is capable not to emit a signal to the loudspeaker 12 even when the alarm tag 1 is opened so that the switch opens the circuit. The first frequency can be low, for example 50 cps. The control circuit 11 in its simplest design can consist of a C-MOS-gate capable to allow to pass through a signal from an oscillator (not shown) when the circuit 19,8,18 is opened, but not to allow the signal to pass through from the oscillator when voltage from the detector circuit 10 is applied on the gate.

At the embodiment shown in FIG. 3 the control circuit comprises an oscillator for driving the loudspeaker 12. A battery 22 is provided in the alarm tag for driving the control circuit 11. A detector 23 preferably is provided to sense the battery voltage. When the battery voltage drops below a certain level, the detector is arranged to emit a signal to the control circuit 11, which thereby is capable to create an easily recognizable signal to the loudspeaker 12, for example a signal consisting of short pulses separated by long intervals, where the pulses consist of a frequency within the audible range.

The aforedescribed alarm tag, according to one embodiment, can in addition be provided with a strip of soft-magnetic material capable to receive an electromagnetic alternating field emitted from a pair of gates 24,25 located at a certain spaced relationship, see FIG. 7. The gates form an investigation zone, through which the customer has to pass, as indicated by arrow 26, on the way to the exit of the place of sale.

The soft-magnetic material, or alternatively a resonance circuit, affects the emitted alternating field. In the gates 24,25 receiving coils are provided in order by means of said agitation to detect whether or not there is an alarm tag in the investigation zone. For this purpose an emitting and receiving device 27 is provided, to which the emitting and receiving coils in the gates are connected. A detector device 28 also is provided which, in the case that an alarm tag is detected in the investigation zone, is capable to trigger an alarm and thereby drive a loudspeaker 29 or lamps 30. Such an investigation and alarm arrangement is described a.o. in the Laid-Out Document Sweden No. 440 833.

According to another preferred embodiment of the alarm tag, the said means for receiving an alternating field emitted to the alarm tag comprise a receiving circuit comprising a coil 31 and a second detector circuit 32. The detector circuit can consist of a capacitor, which together with the coil 32 forms a second LC-circuit tuned to a second predetermined frequency F2. Said second frequency F2 preferably is much higher than said first predetermined frequency, for example 10 kc/s. The detector circuit 32 is capable upon the receipt of an alternating field of said second frequency, possibly via a diode 33, to emit a signal to the control circuit 11, which thereby is capable to emit a signal to the loudspeaker 12.

The alternating field of the second predetermined frequency is emitted by gates 24,25 of the aforesaid kind.

According to said lastmentioned embodiment, thus, the alarm tag will emit an acoustic signal not only when it is opened unpermittedly, but also when it passes through an investigation zone. The staff thereby easily can identify the person who has moved the alarm tag through the investigation zone. At present it is a great problem at the sounding of such an alarm to identify, who of the customers having passed or passing through an investigation zone has carried an alarm tag through said zone.

By using a resonance circuit 31,32, furthermore, the aforedescribed alarm system 24,25,27,28,29,30 can be arranged to detect the alarm tag, so that this alarm system triggers an alarm at the same time as the alarm tag emits an acoustic signal.

According to one embodiment of the alarm tag, the acoustic signal has a frequency within the audible range. The attention of the staff can hereby directly be called to the fact, that somebody has opened the alarm tag unpermittedly, for example in a try-on booth or in some other place, or that somebody has passed through an investigation zone with an alarm tag. At this embodiment, an investigation zone can consist only of emitting coils.

According to another embodiment of the alarm tag, the acoustic signal has a frequency outside the audible range, preferably a high frequency, for example 60–100 kc/s. According to this embodiment of the alarming device according to the invention, the alarming device comprises a sound-sensitive device, for example a microphone 34,35, which is tuned by means of a filter 36,37 to the frequency of the acoustic signal. The sound-sensitive device 34,35 is connected to a drive circuit 38,39 capable to drive alarm devices, such as loud-speaker 40 and/or lamps 41, when the sound-sensitive device 34,35 has received sound of the frequency of the acoustic signal.

Such microphones 34 can be installed in many places in a shop or department store and connected to a common alarm system. The alarm system preferably comprises indicating means, for example in the form of flashing lamps, positioned close to the respective microphone 34, so that the staff can see where in the shop the alarm tag having triggered the alarm is located.

The advantage with a non-audible acoustic signal is that a frequency can be chosen, which is easier to distinguish and detect that sound of audible frequency, because in shops and department stores there is often a high sound level of audible frequencies. For rendering it possible for the staff to easily identify the person carrying an alarm tag emitting non-audible sound, a portable device 42 can be provided which comprises the said means 35,37, 39 and where the drive circuit drives a light emitting diode 43.

In cases where an investigation zone comprises only emitting coils, and the alarm tag is capable upon detection of an alternating field with said second predetermined frequency to emit an acoustic signal of non-audible frequency, a microphone 34 can be located at the gates 24,25 to trigger an alarm.

In the foregoing two coils 9,31 have been mentioned. It is possible, however, to use only one coil, which is coupled to two detecting circuits 10,32 in th form of tuned filters, which detecting circuits are connected to the control circuit 11.

It is apparent from the aforesaid, that the alarm tag emits a signal when an investigation is being passed through and when the tag is opened unpermittedly. Unpermitted opening takes place when the alarm tag is in its active state.

In order to put the tag in its second, inactive, state by means of a magnetic field of low frequency emitted to the tag, at cashier's desks 44 with a cash register 47, see FIG. 6, preferably two coils 45,46 are provided to emit the lower frequency. The coils 45,46 are located each on one side of the area where the shop assistant works when the article is being paid for. The coils 45,46 are driven by an emitter device 49. When the customer places the article on the desk 44, thus, the alarm tag is put in its inactive state, and the shop assistant easily and rapidly can remove the tag without causing the triggering of alarm. At the desk special means for opening the tag are provided, which means are of known type.

According to a preferred embodiment, the control circuit 11 is arranged so that it cannot be put in active state unless the switch 8 has been closed after it had been opened, as is the case at authorized opening of the tag.

In order to prevent the loudspeaker 12 from being easily damaged, a remaining wall section 48 or a metal membrane or corresponding device is located between the loudspeaker and surrounding area. The alarm tag preferably is made of a plastic material with high strength, in order to render its destruction difficult.

In the foregoing an alarm tag with two hingedly connected parts 2,3 has been described. The second part 3, however, of the alarm tag can be separate from the first part 2. In this case the second part 3 is formed like a mushroom-shaped hat, from which a needle projects which is to be lowered into a hole in the first part 2 and locked relative to the first part by means of a locking member of the said and known kind. According to this embodiment, the needle preferably is capable in the bottom of said hole to actuate a contact sheet for closing said circuit. When the needle is drawn up out of the hole, the contact sheet opens said circuit, whereby alarm is triggered when the alarm tag is put in its active state.

A number of embodiments have been described above by way of examples. It is obvious, that the alarm device and especially the electronic parts of the alarm tag can be designed in several different ways for bringing about an alarm tag with the aforedescribed properties, viz. a.o. to emit a signal when it is opened unpermittedly.

The present invention, therefore, must not be regarded restricted to the embodiments described above, but can be varied within its scope defined in the attached claims.

We claim:

1. An alarm device, comprising a so-called alarm tag consisting of two parts arranged so as to be placeable each on one side of an article, for example an article of clothing, of fur or other article, where a needle is provided to extend from one part through the article to the second part, which alarm tag comprises means for receiving a magnetic alternating field emitted to the alarm tag, which tag (1) comprises devices (8–12) capable to emit an acoustic signal when the parts (2,3) of the alarm tag (1) move away from each other when the alarm tag (1) is in a first, active, state and not to emit an acoustic signal when the parts (2,3) of the alarm tag (1) move away from each other when the alarm tag (1) is put in a second, inactive, state, said devices (8–12) comprising a switch (8), a coil (9), a detector circuit (10), a control circuit (11) and a loudspeaker (12), which devices are attached in the alarm tag (1) and are in operable communication with each other, where said switch (8) is capable when the parts of the alarm tag (1) move away from each other to open an electric circuit, and the control circuit (11) is capable to emit a signal to the loudspeaker (12) when the alarm tag (1) is put in said active state, characterized in that said switch (8) comprises one or several needles (6,7), which needle or needles (6,7) in closed position of the alarm tag are arranged to form a closed electric circuit between the two parts (2,3) of the alarm tag, where said electric circuit is opened when said needle or needles (6,7) are moved away from one (2,3) or the other (3,2) part of the alarm tag, and in that one of said devices for putting the alarm tag in an inactive state comprises a receiving circuit comprising said coil (9) and a first detector circuit (10), where said receiving circuit is tuned to a magnetic alternating field of a first predetermined frequency (F1), and that the detector circuit (10) is capable to emit a signal to the control circuit (11) to put the alarm tag in the inactive state when an alternating field of said first predetermined frequency (F1) is detected.

2. An alarm device as defined in claim 1, characterized in that one or several needles (6,7) are attached in a first part (3) of the two parts (2,3) of the alarm tag (1), and that the needle or needles (6,7) is/are arranged to co-operate with electric conductors (16,17) in a second one (2) of the two parts of the alarm tag (1).

3. An alarm device as defined in claim 1, characterized in that said devices for receiving a magnetic alternating field emitted to the alarm tag comprise a receiving circuit comprising a coil (31) and a second detector circuit (32) tuned to a second predetermined frequency (F2), and that the second detector circuit (32) is capable upon detection of an alternating field of said second frequency (F2) to emit a signal to the control circuit (11), which is capable thereby to emit a signal to the loudspeaker (12).

4. An alarm device as defined in claim 1, characterized in that said acoustic signal has a frequency within the audible range.

5. An alarm device as defined in claim 1, characterized in that said acoustic signal has a frequency outside the audible range, preferably a high frequency.

6. An alarm device as defined in claim 5, characterized in that it comprises a sound-sensitive device (34;35), for example a microphone, tuned to the frequency of the acoustic signal, and that the sound-sensitive device (34;35) is connected to a drive circuit (38, 39) capable to drive alarm devices, such as loudspeakers (40) and/or lamps (41;43) when the sound-sensitive device (34;35) has received sound of the frequency of the acoustic signal.

* * * * *